US006471235B1

(12) United States Patent
Luitz et al.

(10) Patent No.: US 6,471,235 B1
(45) Date of Patent: Oct. 29, 2002

(54) BINDING MOUNTING SYSTEM AND METHOD OF RAPIDLY MOUNTING FRONT AND HEEL JAWS OF A SKI BINDING

(75) Inventors: Max Luitz, Blaichach-Bihlerdorf (DE); Adolf Stonig, Kleinarl; Helmut Holzer, Wagrain, both of (AT)

(73) Assignee: Atomic Austria GmbH, Altenmarkt Im Pongau (AT)

( * ) Notice: Subject to any disclaimer, the term of this patent is extended or adjusted under 35 U.S.C. 154(b) by 10 days.

(21) Appl. No.: 09/654,597

(22) Filed: Sep. 1, 2000

(30) Foreign Application Priority Data

Sep. 21, 1999 (AT) ..... 1606/99

(51) Int. Cl.[7] ..... A63C 9/08
(52) U.S. Cl. ..... 280/618; 280/634; 403/109.1
(58) Field of Search ..... 280/617, 618, 280/611, 613, 616, 623, 607, 633, 634, 620; 403/105, 107, 109.1, 364

(56) References Cited

U.S. PATENT DOCUMENTS

| | | | | | |
|---|---|---|---|---|---|
| 3,731,943 | A | * | 5/1973 | Wilkes | 280/613 |
| 3,950,001 | A | * | 4/1976 | Weigl | 280/618 |
| 4,022,493 | A | * | 5/1977 | Weigl et al. | 280/633 |
| 4,340,242 | A | * | 7/1982 | Gertsch | 280/618 |
| 4,585,250 | A | * | 4/1986 | Nowak et al. | 280/618 |
| 4,955,633 | A | * | 9/1990 | Stritzl et al. | 280/618 |
| 4,997,199 | A | * | 3/1991 | Horn | 280/618 |
| 5,056,808 | A | * | 10/1991 | Klaus et al. | 280/605 |
| 5,085,453 | A | * | 2/1992 | Bildner | 280/612 |
| 5,186,484 | A | * | 2/1993 | Coudec | 280/633 |
| 5,211,417 | A | * | 5/1993 | Klaus et al. | 280/617 |
| 5,224,730 | A | * | 7/1993 | Provence et al. | 280/615 |
| 5,344,179 | A | * | 9/1994 | Fritschi et al. | 280/14.21 |
| 5,348,335 | A | * | 9/1994 | Dasarmaux et al. | 280/618 |
| 5,611,559 | A | * | 3/1997 | Luitz et al. | 280/617 |
| 5,642,897 | A | * | 7/1997 | Couderc et al. | 280/605 |
| 5,732,968 | A | * | 3/1998 | Wladar et al. | 280/618 |
| 5,794,962 | A | * | 8/1998 | Bardin et al. | 280/607 |
| 6,065,895 | A | * | 5/2000 | Lehner et al. | 280/618 |
| 6,092,829 | A | * | 7/2000 | Mercier | 280/617 |

FOREIGN PATENT DOCUMENTS

| | | | | |
|---|---|---|---|---|
| DE | 265409 | * | 2/1978 | 280/633 |
| DE | 3924899 | * | 2/1990 | 280/633 |
| DE | 3927144 | * | 6/1990 | 280/633 |
| DE | 4016102 | * | 11/1990 | 280/633 |
| DE | 41 35 899 | | 6/1992 | |
| EP | 034453 | * | 12/1989 | 280/633 |
| EP | 0 383 104 | | 8/1990 | |
| EP | 0403675 | * | 12/1990 | 280/618 |
| FR | 490824 | * | 6/1992 | 280/618 |
| WO | WO 87/01351 | * | 3/1987 | 280/633 |
| WO | WO 88/04563q | * | 6/1988 | 280/618 |

* cited by examiner

*Primary Examiner*—Brian L. Johnson
*Assistant Examiner*—Bridget Avery
(74) *Attorney, Agent, or Firm*—Collard & Roe, P.C.

(57) ABSTRACT

A binding mounting system for rapidly mounting a slidable front jaw and a slidable heel jaw of a ski binding onto a ski having a top face, comprises a plate-shaped base element having a bearing surface and mounted on the top face of the ski, front rear longitudinal guide mechanisms on the base element, the guide mechanisms preventing vertical and transverse displacements of the front jaw and the rear jaw to be mounted on the base element relative to the bearing surface thereof, and a positioning and locking device immobile relative to the base element and mounted thereon between the front and rear longitudinal guide mechanisms at a distance therefrom. The positioning and locking device has a top face remote from the base element and at least one rigid raised portion with steep flanks on the top face. At least one bar-shaped linking member extends towards a respective one of the guide mechanisms and has an end linked to a respective one of the jaws, the linking member having several recesses in an end opposite to the end linked to the one jaw, the recesses matching the raised portion to provide a positive fit between the raised portion and one of the recesses.

20 Claims, 5 Drawing Sheets

BINDING MOUNTING SYSTEM AND METHOD OF RAPIDLY MOUNTING FRONT AND HEEL JAWS OF A SKI BINDING

BACKGROUND OF THE INVENTION

1. Field of the invention

The invention relates to a binding mounting system for rapidly fitting a front and heel jaw of a ski binding onto a ski, having at least one plate-shaped base element mounted on a top face of a ski and at least a first and a second longitudinal guide mechanism, formed by the base element or provided separately and secured to the base element, in order to prevent vertical and transverse displacements of a respective front and heel jaw, to be mounted thereon, relative to a bearing surface of the base element on a ski and having a positioning and locking device which is immobile relative to the base element, mounted between the front and the rear longitudinal guide mechanism spaced at a distance thereafter, by means of which slidable front and heel jaws can be positioned and secured across at least one bar-shaped linking member as well as a method of rapidly fitting front and heel jaws of a ski binding onto a ski having a respective longitudinal guide mechanism co-operating with the front and heel jaw, spaced at a distance apart from one another and in which the front and heel jaws can be positioned and secured.

2. The Prior Art

Document DE 41 35 899 A1 describes a ski binding which enables a synchronous adjustment of the front and heel jaws in opposite directions by means of a gear mechanism between the front and heel jaws. To this end, a gear wheel is rotatably mounted in the central region between front and heel jaws and bar-type racks lying diametrically opposite one another engage in the central gear wheel. The end region of the first rack remote from the gear wheel is connected to the front jaw and the end region of the second rack remote from the gear wheel is connected to the heel jaw. The front and heel jaws are slidably retained in their respective longitudinal guide positions by the racks. A checking device also co-operates with the central gear wheel, by means of which the rotating action of the gear wheel can be locked. The checking device must be capable of withstanding high turning moments and high torsional forces and is therefore robust and of a relatively complex design.

SUMMARY OF THE INVENTION

The underlying objective of this invention is to provide a binding mounting system by means of which a ski binding can be provided to the customer's requirements by the retail outlet, rapidly and in a simple manner, enabling the front and heel jaws to be locked in the appropriate positions in a practical manner.

This objective is achieved in that the positioning and locking device has at least one rigidly moving raised portion with steep flanks to provide a positive-fit meshing action in at least one of several matching recesses or orifices in a co-operating region of a bar-shaped linking member extending in a direction towards the front or rear longitudinal guide mechanisms in order to link the end region thereof to a front or heel jaw.

The advantage is that a plate-shaped base element is provided and pre-mounted on an appropriate ski at the factory. A retail outlet or distributor then merely has to assemble a ski binding unit to suit the wishes of the customer or purchaser and place it on the appropriate ski by means of the binding mounting system, which is then ready for use within a short time without the need to drill any bores. Due the modular design of the structure, no more waiting times are needed for the fitting process. Assembly is assisted by the central positioning and locking device provided as the central element of the binding mounting system, whereby both the front and heel jaws of a ski binding can be simultaneously retained and locked by means of this positioning and locking system. Consequently, the corresponding ski binding can be assembled and adjusted on an appropriate ski fitted with a pre-mounted binding mounting system in a very short time and without any difficulty. However, not only does the structure of the positioning and locking device enable front and heel jaws to be assembled rapidly, it also permits numerous options for adjusting the ski binding relative to the ski. In particular, the design of the positioning and locking device enables the distance between front and back jaws to be adjusted and locked on the one hand whilst the relative position of the entire ski binding unit can be adjusted with respect to the base element and with respect to the ski and locked in the desired position. Using this central positioning and locking device, which is relatively simple in structure, a whole series of adjustments can therefore be made and a central locking member operated to produce a reliable lock or fastening in the desired positions selected.

Another embodiment, where the positioning and locking device has several raised portions running transversely to the longitudinal direction of the base plate in the plane parallel with the bearing surface of the base element, in particular teeth with steep flanks to mesh in a positive fit in teeth of a matching design in a facing end region of the bar-shaped linking member to the front or heel jaw, is of advantage since it allows relatively fine adjustments to be made whilst nevertheless providing a very stable and strong positioning and locking device and bar-shaped binding elements.

Advantages are also to be had from an embodiment, where the positioning and locking device has a screw-type fixing member or a threaded nut with a screw axis running perpendicular to the bearing surface of the base element, by means of which the bar-shaped linking member can be vertically adjusted relative to the raised portion or teeth, optionally providing a releasing action or a checking action and in the latter case the front or the heel jaw is secured and checked in the longitudinal direction of the co-operating longitudinal guide mechanism or when the fixing member or the threaded nut is in a released position, the facing end region of the bar-shaped linking member is released so that it can be displaced in a vertical direction or in the direction of the flanks of the raised portions and is prevented from displacement in the locked position, which provides a fixing member that is safe in operation and easy to operate and also conforms to high safety standards.

Another advantageous embodiment offers recesses or teeth of relatively deep dimensions on the bottom flat face of the bar-shaped binding element, which are capable of withstanding relatively high forces as compared with laterally disposed teeth.

Another advantage of the a binding mounting system is that the second jaw body can be positioned in a stepped arrangement relative to the first jaw body without having to alter the position of the first jaw body when adjusting the second jaw body.

An embodiment, where the end regions of the two flush-aligned linking members facing the positioning and locking device are of a fork-shaped design or have slit-shaped nicks running in the longitudinal direction thereof, starting from the ends facing the positioning and locking device, offers an advantage because the fixing member can be arranged centrally relative to the binding elements, as a result of which a uniform, evenly balanced contact force can be exerted on the binding elements.

The two-part design of the binding element reduces any undesirable stiffening of a ski in its central region once the binding mounting system has been fitted.

The binding mounting system obviates the need to set the positioning and locking device independently, thereby reducing the time and effort needed for assembly purposes.

The invention also permits high pick-up forces in the fixing member, thereby producing an arrangement that is highly unlikely to be ripped out.

Also of advantage is that the braking device does not have to be screwed to the ski separately either, thereby reducing the assembly time needed by the retailer or shop.

An embodiment with universal adjustment options and a rapid locking action in the desired position, whilst simultaneously permitting longitudinal compensation during bending of the ski in order to prevent any strain is also of advantage.

Also of advantage is an embodiment, in which the first bar-shaped linking member projects out from the front jaw and the second strip-shaped linking member from the heel jaw or the first longitudinal guide mechanism is designed to push in the front jaw with the bar-shaped linking member and the second longitudinal guide mechanism to push in the heel jaw with the bar-shaped linking member, starting from the end regions thereof remote from one another, because only the unit comprising the binding element and jaws needs to be pushed into and locked in the desired position.

The embodiment, where a cover element of a substantially U-shaped cross section is provided for the positioning and locking device, offers protection against icing and a build-up of snow whilst providing more design options.

An additional fixing member for the cover element, such as a fixing screw, is no longer needed due to a practical embodiment wherein, in order to retain the front and heel jaws by means of the central fixing member, the cover element can be mounted above the positioning and locking device, thereby at least partially covering the bar-shaped linking member.

Another adjustment option for a jaw relative to the binding element is provided by a binding mounting system, wherein the front and/or heel jaw can be adjusted in the longitudinal direction of the bar-shaped linking member by means of a threaded spindle arrangement.

Due to an other embodiment, wherein the bar-shaped linking member can be connected to or removed from the front and/or heel jaw by means of a detachable connecting device if necessary, compact packing units are provided so that the individual components can be readily re-assembled by the user in a straightforward manner.

When the teeth of the positioning and locking device in the longitudinal section of the base element are designed as square-shaped raised portions or recesses with steep, e.g. almost vertical, flanks standing up from the horizontal plane, a coupling or jaw part which can be set to a desired position will no longer slide once placed in the relevant position and the other jaw part can then be set and positioned effortlessly in the binding mounting system.

An embodiment, where the top face of the first bar-shaped linking member and the underside of the second bar-shaped linking member have triangular or wave-shaped raised portions or teeth with relatively flat flanks in longitudinal section, permits a relative sliding action between the first binding element and the second binding element without having to also move the second binding element when one of the two binding elements is adjusted.

The embodiment, wherein the end regions of the two linking members facing one another overlap with one another in the operating position and the fixing member is inserted through the overlapping region of the two linking members and can be applied to the positioning and locking device, offers a sufficiently large adjustment range and a secure fastening for the front and heel jaws.

Finally, pre-mounting the binding mounting system and the plate-shaped base element on the ski at the factory, is particularly advantageous because there is no need for the retailer or end-user to drill any holes in or make any other modifications to the ski in order to fit the binding mounting system or the ski binding and the sports article can be combined with the desired ski binding components in a modular design.

Independently of the above, however, the objective set by the invention can also be achieved by a method of rapidly fitting front and heel jaws of a ski binding onto a ski having a respective longitudinal guide mechanism co-operating with the front and heel jaw, spaced at a distance apart from one another and in which the front and heel jaws can be positioned and secured.

The advantages reside in the fact that the desired ski binding unit can be mounted on the ski in a relatively short time without the need for any tensioning work, e.g. drilling bores. Another advantage is the fact that the modular structure is compatible with the most varied of coupling components, as may be required by the customer, i.e. front and heel jaws can be fitted on a ski with a pre-fitted binding mounting system. Another advantage resides in the fact that an adjustment range of approximately 100 mm can be provided to cater for the shortest and longest length of sole without any problem. Also of advantage is the fact that both the distance between front and heel jaws and the relative position of the ski binding unit with respect to the ski can be adjusted and locked in a simple manner by means of a central fixing member. Another advantage is that the stages in the adjustment path rule out any unacceptable sliding in to intermediate positions.

BRIEF DESCRIPTION OF THE DRAWINGS

The invention will be described in more detail below with reference to examples of embodiments illustrated in the drawings, wherein.

DETAILED DESCRIPTION OF PREFERRED EMBODIMENTS

Firstly, it should be pointed out that the same reference numbers and the same component names are used to denote same parts in the different embodiments described, so that disclosures made throughout the description can be transposed in terms of meaning to same parts bearing the same reference numbers or same component names. Similarly, the specific positions selected in the description, e.g. top, bottom, side, etc., refer to the actual drawing being described and, when a different position is described, can also be transposed in terms of meaning to the new position. Furthermore, individual features from the different examples of embodiments illustrated may be regarded as independent solutions to the invention in their own right.

Figure 1:
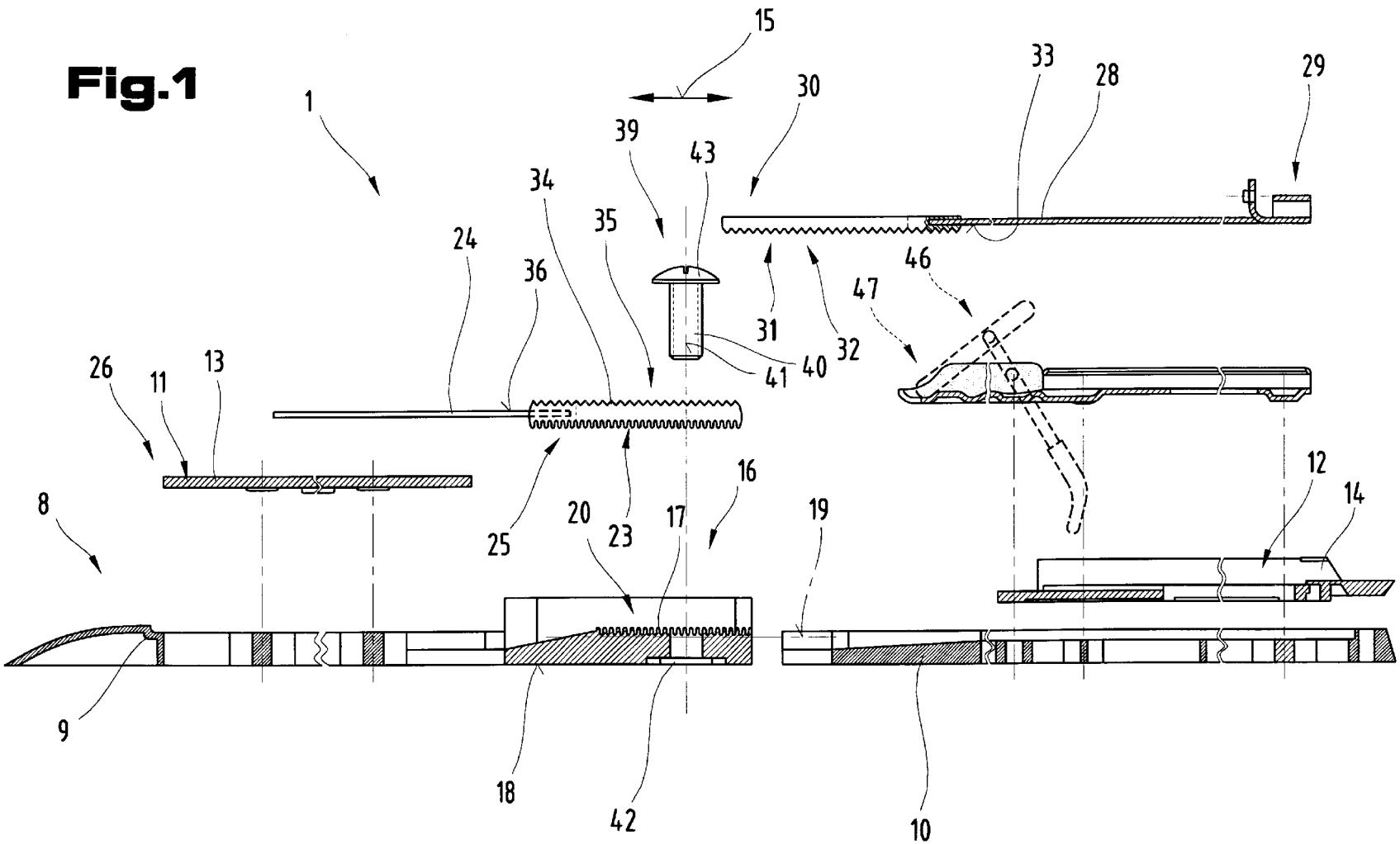
FIG. 1 shows an exploded diagram in partial section showing the binding mounting system proposed by the invention, to be pre-mounted on a ski, seen from a side view and in a very simplified format.
Figure 2:
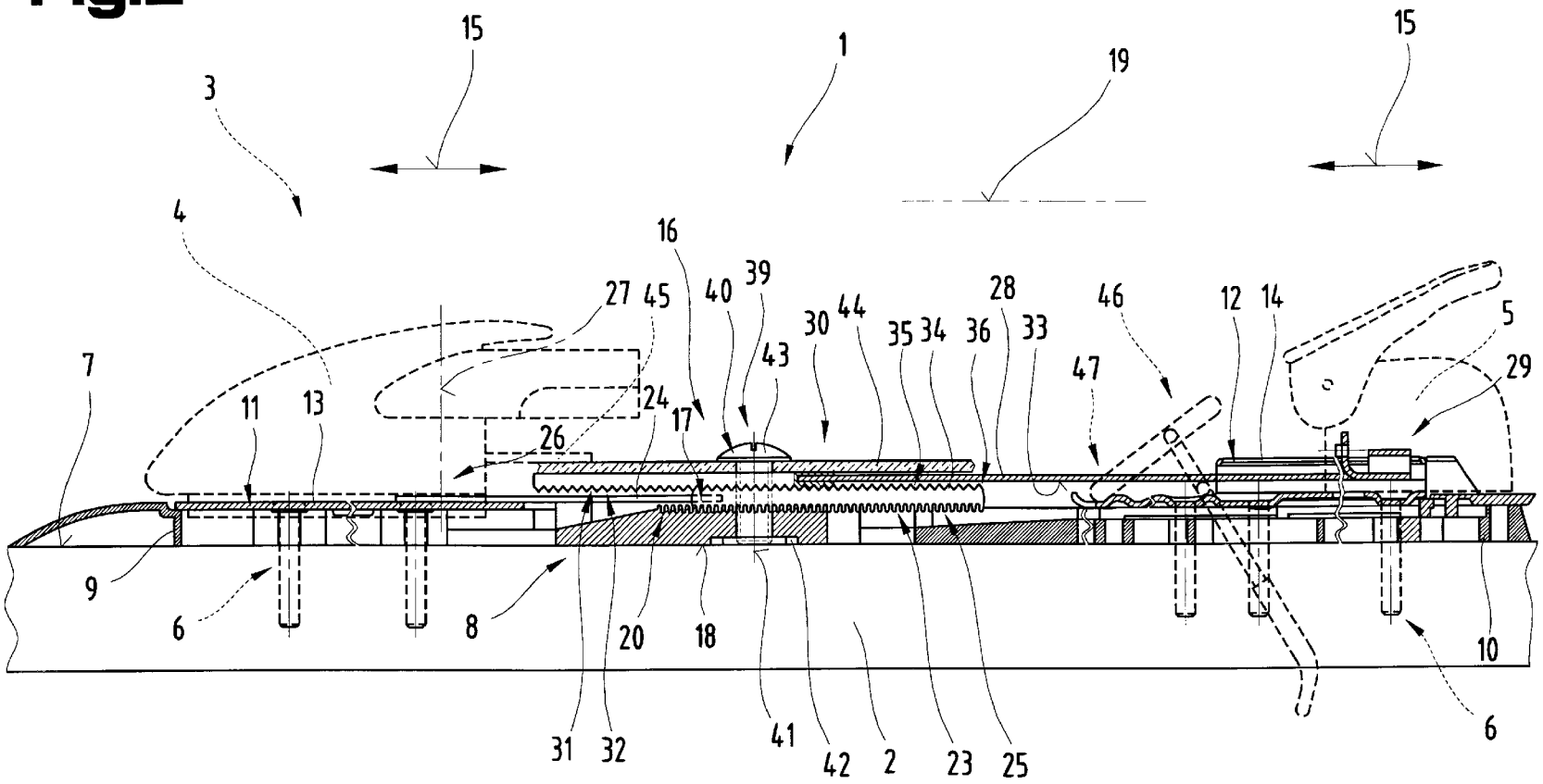
FIG. 2 shows a very simplified, schematic diagram of the binding mounting system illustrated in FIG. 1 assembled with a ski, the broken lines indicating front and heel jaws.
Figure 3:
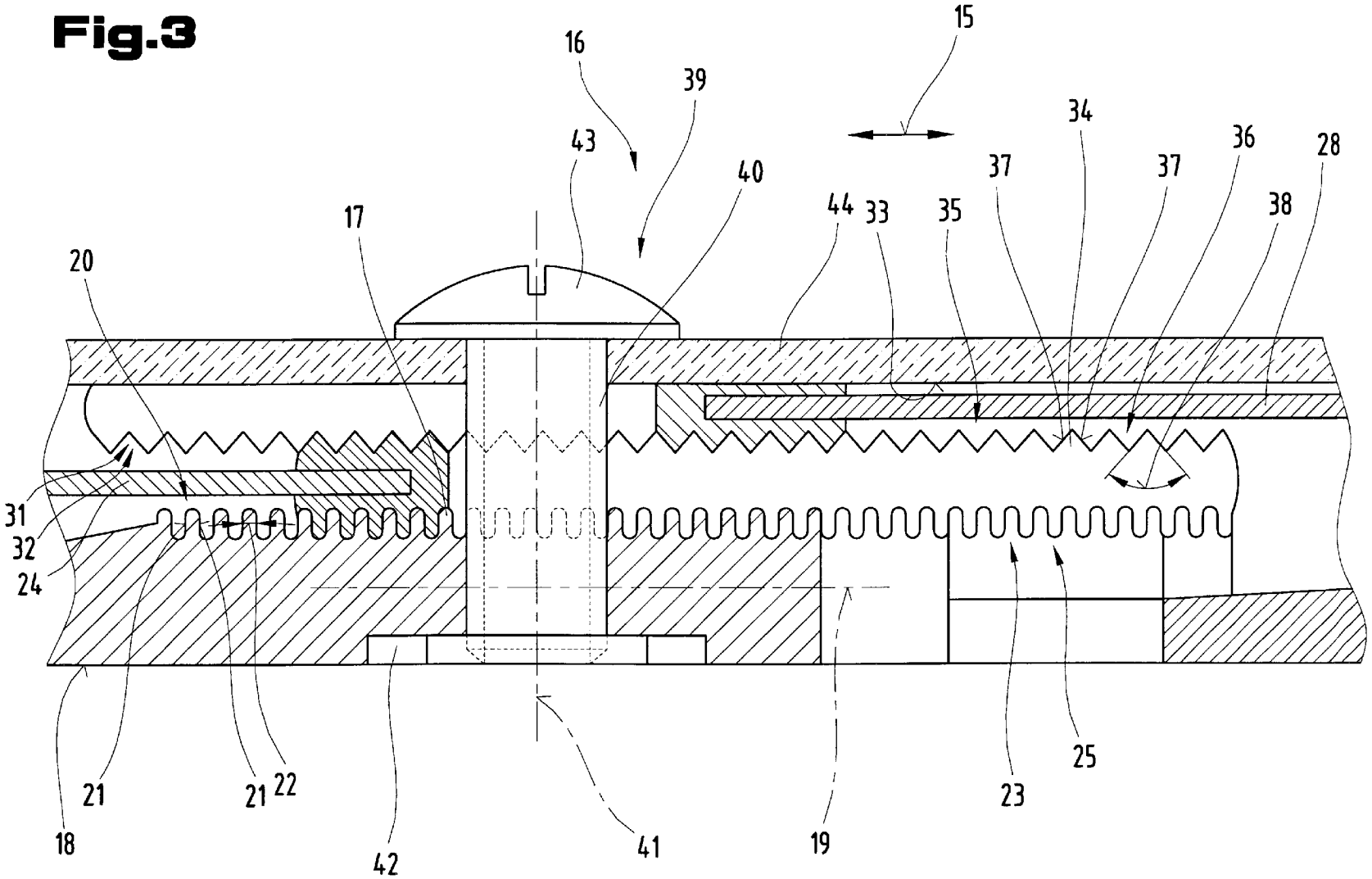
FIG. 3 shows an enlarged section showing the part-region of the fixing and positioning device of the binding mounting system illustrated in FIG. 2.

FIGS. 1 to 3 illustrate an embodiment of the binding mounting system 1 proposed by the invention. This binding mounting system 1 is pre-mounted on an appropriate ski 2, in particular an Alpine ski, at the factory, after which a desired ski binding 3 merely has to be fitted with the binding mounting system 1 by the retailer or user, which will take very little time and will require no drilling work. The ski binding 3 consists, as standard, of a front jaw 4 for releasably retaining the front region of a ski boot and a heel jaw 5 for releasably retaining the heel region of the ski boot of a skier.

The binding mounting system 1 is secured to the top face 7 of the ski 2 by means of fixing elements 6, in particular by standard fixing screws. The plate-shaped binding mounting system 1 is mounted on the ski 2 at the factory by the manufacturer of the skis 2 and the binding mounting system 1.

The binding mounting system 1 comprises at least one plate-shaped base element 8 which is firmly screwed onto the top face 7 of the ski 2 by means of the fixing elements 6 for the purpose of mounting the ski binding 3. The base element 8 or binding mounting system 1 is therefore disposed between the top face 7 of the ski 2 and the ski binding 3 that will subsequently be mounted by the retailer, customer or user.

By preference, the plate-shaped base element 8 is made in two parts and comprises a front plate component 9 for the front jaw 4 and a separate rear plate component 10 assigned to the heel jaw 5. The base element 8 or plate components 9. 10 are preferably made from a plastics material and are preferably injection-moulded components.

The base element 8 or the plate components, 10 have longitudinal guide mechanisms 11, 12 for the front jaw 4 and the heel jaw 5. The longitudinal guide mechanism 11 for the front jaw 4 and the longitudinal guide mechanism 12 for the heel jaw may be integral elements of the plate components 9, 10, in which case appropriate guide paths will be moulded into the plate components 9 and 10.

By preference, however, the longitudinal guide mechanisms 11, 12 for the front and back jaws 4, 5 will be provided as separate guide components 13, 14 made from a metal material.

The guide components 13, 14 can therefore be mounted on the respective plate components 9, 10 and, like the plate components 9, 10, the fixing elements 6 will be inserted through them in order to provide a screw fitting with the ski 2. The guide components 13, 14 and the plate components 9, 10 lying underneath them are therefore jointly mounted and firmly screwed onto the ski 2 by means of the same fixing elements 6. The cross section of the longitudinal guide mechanisms 11, 12 and the guide components 13, 14 may be squared, C- or U-shaped or alternatively of other designs that will enable the front and heel jaws 4, 5 to be slidably guided in a longitudinal direction. The underside of the housing of the front and heel jaws 4, 5 will have guide regions or guide members matching the respective guide components 13, 14.

The longitudinal guide mechanisms 11, 12 and the guide components 13, 14 operate in conjunction with the matching guide members on the front and heel jaws 4, 5 to allow the front jaw 4 and the heel jaw 5 to slide independently of one another in a longitudinal direction—arrow 15—of the base element 8 or the ski 2. The capacity of the front jaw 4 and the heel jaw 5 to move in the longitudinal direction—arrow 15—of the base element 8 or the ski 2 is the only freedom of movement which the ski binding 3 is permitted by the respective longitudinal guide mechanisms 11, 12. In a direction perpendicular to the plate-shaped base element 8 and to the plate components 9, 10 and in all directions running transversely to the longitudinal direction—arrow 15—the front jaw 4 and the heel jaw 5 are held immobile by the longitudinal guide mechanisms 11, 12. The longitudinal guide mechanisms 11, 12 therefore permit a linear sliding action of the front jaw 4 and the heel jaw 5 in a longitudinal direction—arrow 15—of the base element 8 or ski 2 only.

The binding mounting system 1 also has a positioning and locking device 16 to retain the front jaw 4 and the heel jaw 5 in the desired, adjustable position in the longitudinal guide mechanisms 11, 12 relative to the plate components 9, 10. The positioning and locking device 16 therefore prevents the front jaw 4 and the heel jaw 5 from totally sliding out of the longitudinal guide mechanisms 11, 12 when in the activated position. The positioning and locking device 16 is disposed between the front and rear longitudinal guide mechanisms 11, 12 and is permanently fixed to the ski 2. By preference, the positioning and locking device 16 is assigned to the front plate component 9 and is rigidly joined thereto. Advantageously, the positioning and locking device 16 is moulded onto the front plate component 9 so that the front plate component 9 and the positioning and locking device 16 form an integral unit. The positioning and locking device 16 is therefore also non-slidably secured to the ski 2 when the front plate component 9 is mounted on the ski 2.

The permanently fixed positioning and locking device 16 has at least one raised portion 17, relative to a plane 19 parallel with the top face 7 of the ski 2 and parallel with a bearing surface 18 of the binding mounting system 1 on the ski 2. By preference, a plurality of raised portions 17 are provided in the form of teeth 20, aligned in the plane 19 parallel running parallel with the bearing surface 18. The raised portions 17 or the teeth 20 run transversely to the longitudinal direction—arrow 15—and transversely to the guide direction of the longitudinal guide mechanisms 11, 12 and are essentially parallel with the bearing surface 18 of the binding mounting system 1 facing the ski 2. The raised portions 17 or teeth 20 spaced apart from one another in the longitudinal direction—arrow 15—have relatively steep flanks 21 or relatively steep tooth flanks with respect to the horizontally lying plane 19. A flank angle 22 between two flanks 21 of a raised portion 17 will subtend an angle of between 0° and 90°. In the first of these extreme instances in which the flank angle 22 is 0°, the two flanks 21 of a raised portion 17 extend parallel with one another, which means that this is the steepest design that can be selected for the flanks 21 or raised portions 17 relative to the plane 19. A possible flank angle of from 0° to 90° therefore means that both flanks 21 of a raised portion 17 can assume anything from an acute angle to a maximum right-angle.

The raised portion 17 or the teeth 20 of the positioning and locking device 16 are designed to mesh in a positive fit with recesses 23 of a matching design on a bar-shaped linking member 24. The recesses 23 on this linking member 24 are preferably designed to have teeth 25 which match the stationary teeth 20. The strip or bar-shaped linking member 24 has teeth 25 in one of its end regions. In the end region 26 remote from the teeth 25, the linking member 24 is connected to or coupled in displacement with the front jaw 4. The end region 26 of the linking member 24 may be connected to the housing of the front jaw 4 or alternatively with the housing of the heel jaw 5 by means of a rivet, screw and/or catch connection. The connection may also permit a relative pivoting movement of the parts joined to one another about a vertical pivot axis 27. The front jaw 4 or alternatively the heel jaw 5 can therefore be retained and prevented from sliding of its own accord in the respective longitudinal guide mechanism 11, 12 by means of the bar-shaped linking member 24, starting from the central positioning and locking device 16. Particularly when the positioning and locking device 16 is locked in position by the linking member 24, flexibility of which is restricted, the front jaw 4 and the heel jaw 5 will not be able to slide out of the relevant longitudinal guide mechanism 11 or 12.

Furthermore, another strip or bar-shaped linking member 28 is provided, which extends, starting from the central positioning and locking device 16, to the other coupling member of the ski binding 3, in particular to the heel jaw 5. An end region 29 of the linking member 28 co-operating with the heel jaw 5 is moveably coupled with the housing of the rear jaw 5, being riveted, screwed, welded, latchably or otherwise joined thereto. The end region 30 of the linking member 28 co-operating with the positioning and locking device 16 can also be latched and secured in the desired position in the region of the positioning and locking device 16. To this end, in the end region 30 facing the positioning and locking device 16, the linking member 28 has at least one recess 31, preferably several recesses 31 provided in the form of teeth 32. These recesses 31 or these teeth 32 are provided at least on the underside 33 of the linking member 28. The teeth 32 on the underside 33 of the linking member 28 co-operating with the positioning and locking device 16 may be designed so as to mesh in a positive fit with the teeth 20 of the positioning and locking device 16.

By preference, however, the recesses 31 in the second linking member 28 to the heel jaw 5 area designed to mesh in a positive fit in a matching raised portion 34 or in matching teeth 35 on a top face 36 of the first linking member 24. In particular, the recesses 31 on the underside 33 of the second linking member 28 can be displaced by meshing in a positive fit with matching raised portions 34 on the top face 36 of the first linking member 24.

The raised portions 34 on the top face 36 of the first linking member 24 have flanks 37 aligned in a relatively flat arrangement. In particular, a flank angle 38 between two flanks 37 of a raised portion 34 is between 90° and 170°. In other words, the flanks 37 of the raised portions 34 on the top face 36 of the first linking member 24 may assume anything from a right-angle to an almost extended flank angle 38. In particular, two flanks 37 of a raised portion 34 subtend a right-angle or an obtuse angle.

Due to the relatively steep flanks 21 of the first linking member 24, the latter can be latched into the desired position by means of the positioning and locking device 16, as a result of which the corresponding coupling member, in particular the front jaw 4 will initially be retained in its position by means of a specific force which can be manually overcome. Thereafter, the end region 30 of the linking member 28 can be pushed onto the linking member 24 and slid along it without causing any shift in the already positioned first linking member 24. This is achieved due to the fact that the relatively steep flanks 21 of the teeth 20 oppose any shift in the already positioned or adjusted linking member 24, whilst the relatively flat flanks 37 on the top face of the linking member 24 permit a relative shift of the second linking member 28 relative to the first linking member 24 lying underneath.

In particular, the second linking member 28 moves in a ratchet action across the top face 36 of the first linking member 24 so that the linking member 28 is displaced in a longitudinal direction—arrow 15.

By preference, the linking member 24 is coupled with the front jaw 4 and the linking member 28 with the heel jaw 5. Consequently, it is preferable if the front jaw 4 is firstly pushed into the front longitudinal guide mechanism 11 of the binding mounting system 1 and positioned accordingly. Then, the heel jaw 5 is pushed into the longitudinal guide mechanism 12 and positioned accordingly at the desired sole length of the respective ski boot. The teeth 25, 32, 35 therefore enable the front or heel jaw 5 to be displaced in a stepped motion. These ratchet steps ensure that the front and rear jaws 4, 5 can be effortlessly and accurately positioned at the position corresponding to the desired sole length, ruling out any unacceptable intermediate positions. Markings can be provided on the base element 8 and/or the linking members 24, 28 to assist in finding the desired or required position of the front and heel jaws 4, 5, as will be explained in more detail below.

The fixing member of the positioning and locking device 16 is preferably provided in the form of a screw-type fixing member 39, by means of which the end regions of the linking members 24, 28 can be pre-tensioned in the direction of the positioning and locking device 16 if necessary. In particular, when the fixing member 39 is activated or if a permanently screwed fixing member is provided, the end regions 30 of the linking members 24, 28 co-operating with the positioning and locking device 16 are prevented from rising so that the positive-fit connection between the raised portions 17, 34 and the co-operating recesses 23, 31 is secured. The fixing member 39 is preferably provided in the form of a fixing screw 40 with a screw axis 41 disposed perpendicular to the bearing surface 18. Accordingly, an internal thread matching the thread of the fixing screw 40 is provided on the positioning and locking device 16 or a threaded but 42 is retained on the positioning and locking device 16, into which a threaded portion of the fixing screw 40 can be screwed. By preference, the threaded nut 42 is a flange nut. The underside of the screw head 43 of the fixing screw 40 therefore acts as a contact surface for applying a contact pressure to the linking members 24, 28 in the direction of the positioning and locking device 16 so that the linking members 24, 28 can be firmly clamped onto the toothed surface of the positioning and locking device 16. For safety reasons, the fixing screw 40 is at least a Phillips screw or a screw that can be operated using a specially designed tool only.

The linking members 24, 28 are preferably bar-shaped members punched from metal plates and are also totally traction and largely crush resistant. However, the strip or bar-shaped linking members 24, 28 are relatively flexible in a direction perpendicular to the bearing surface 18 and are deformable in an elastically resilient manner.

As a result, in the event of any torsion or bending in the binding mounting system 1 in a direction perpendicular to the bearing surface 18, there will be certain longitudinal compensation in the coupling members of a ski binding 3, so that the front and heel jaws 4, 5 will be slidably retained in the co-operating longitudinal guide mechanisms 11, 12.

At least the end regions 30 of the linking members 24, 28 facing the positioning and locking device 16 will be provided in the form of racks so that they can be displaced in a meshing action with the profiled top face of the positioning and locking device 16.

At least a part-region of the positioning and locking device 16 and the toothed regions of the linking members 24, 28 will be covered by a cover element 44 as seen in a plan view and from the side. The cover element 44 prevents any build-up of clumps of ice or snow on the positioning and locking device 16 and the components cooperating with it, e.g. the linking members 24, 28. The cover element 44 has a substantially U-shaped cross section, which means that the cover element 44 may extend at least across part regions of the top face and side regions of the positioning and locking device 16.

A friction-reducing member, in particular a slide plate 45 is provided in the end region of the front jaw 4 facing the positioning and locking device 16, in order to provide low-friction support for a ski boot on the binding mounting system 1. This slide plate 45 is attached to the front jaw 4 or joined therewith in displacement. By preference, the slide plate 45 and the cover element 44 overlap with one another and are telescopically slidable relative to one another. The overlap region is selected such that there will be no gap between the slide plate 45 and the cover element 44 even when the farthest possible slide positions are reached. Because the slide plate 45 is coupled with the front jaw 4 in displacement, the forces on the front jaw 4 in the different positions of adjustment remain largely constant, offering the advantage of safety features. In particular, the coupling between front jaw 4 and slide plate 45 in all positions of adjustment of the ski binding 3 will ensure that the slide plate 45 will always be kept at a distance of approximately 30 mm behind a boot tip.

The cover element 44 may be mounted on the binding mounting system 1 by means of the central fixing member 39 or by means of the fixing screw 40 used to secure the front and heel jaws 4, 5. This being the case, the fixing screw 40 is inserted through the base plate of the U-shaped cover element 44 and the underside of the screw head 43 is moved to bear on the base plate of the cover element 44. When the fixing screw 40 is tightened down, the cover element 44 duly pushes the linking members 24, 28 tightly against the positioning and locking device 16. As a result, not only are the linking members 24, 28 non-slidably secured but the cover element 44 is also firmly clamped. The length of the fixing screw 40 and the dimensions of the cover element 44 are therefore selected so that if not screwed in or if incorrectly screwed in, it will not be possible to use or access a ski binding 3.

Another orifice or a transparent viewing window is provided in the cover element 44 on a level with the fixing member 39 in the longitudinal direction—arrow 15—of the binding mounting system 1 to assist in adjusting the position of front and heel jaws 4, 5. Individual length markings or value specifications on the linking member 24 and the linking member 28 can be seen through this viewing window without having to remove the cover element 44. In order to be able to differentiate more easily between the linking members 24, 28 when adjusting the front and heel haws 4, 5, the linking members 24 and 28 are of different colours.

In an end region facing the front plate component 9, the rear plate component 10 of the binding mounting system 1 houses a braking device 46 for a ski 2, known per se, as indicated by broken lines, used if the ski boot of a user detaches from the ski. A mounting seat 47 for the braking device 46 on the rear plate component 10 is designed so that the braking device 46 forms an independent one-piece unit with the rear plate component 10. This closed unit then merely has to be screwed onto an appropriate ski 2. As with the longitudinal guide mechanism 12, it is preferable if the braking device 46 is pre-mounted on the rear plate component at the factory, in which case the assembled unit delivered to the retailer or end-user will consist of a ski 2 and the binding mounting system 1.

Figure 4:
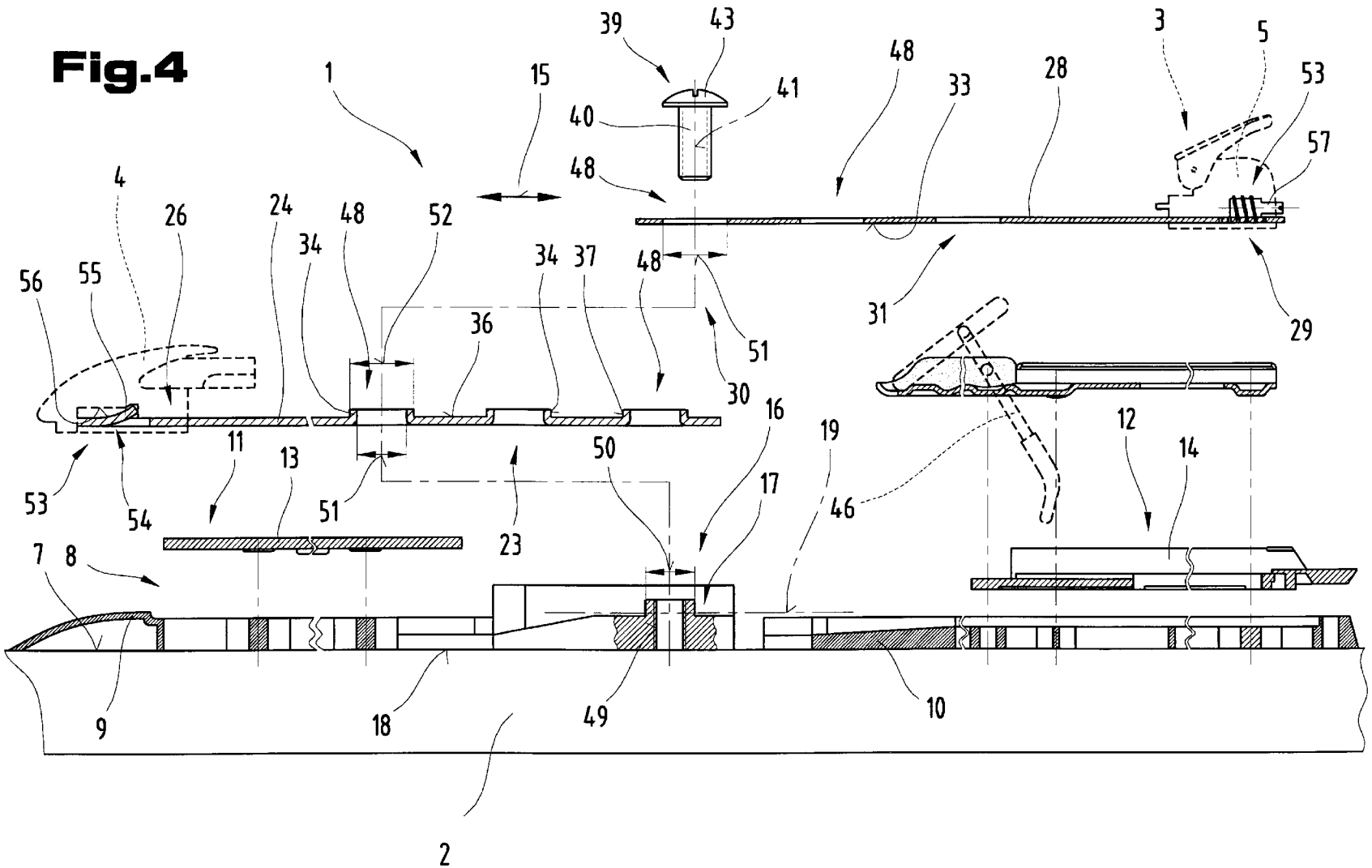
FIG. 4 shows a very simplified, exploded diagram in partial section, showing a different embodiment of the binding mounting system proposed by the invention with a single raised portion on the positioning and locking device.

FIG. 4 illustrates another embodiment of the binding mounting system 1 proposed by the invention, the same reference numbers being used for components already described above.

In this embodiment, the positioning and locking device 16 has a single raised portion 17, which can be displaced by a positive-fit meshing action in one of several orifices 48 in the linking member 24 and/or in the linking member 28. The raised portion 17 of the positioning and locking device 16 is preferably of a cylindrical design and has a central bore with an internal thread 49 in the centre region.

The part of the raised portion 17 which is preferably cylindrical in design and stands out from the plane 19 has an external diameter 50 which more or less matches an internal diameter 51 of the orifices 48 in the linking member 24 and/or 28. Accordingly, the orifices 48 match the raised portion 17 and the raised portion 17 may be inserted in one of the many orifices 48 in the linking member 24 and in the linking member 28 as required.

Optionally, the orifices 48 in one of the linking members 24, 28 may also be designed in the form of crimped indentations with outer lateral faces having a relatively flat elevation, as may be seen from the linking member 24. An internal diameter 51 of the orifices 48 in the second linking member 28 will then approximately match an external diameter 52 of the crimped orifices 48 and raised portions 34 on the linking member 24. By means of the orifices 48 produced by a stamping process and the bulbous raised portions 34 surrounding them, the second linking member 28 can be slid across the raised portions 34 and positioned in steps. The raised portions 34 produced in the linking member 24 by the crimping process so as to have inclined external faces provide an inclined contact surface for the resiliently elastic linking member 28, arranged above, against the linking member 24 lying underneath.

As may also be seen from FIG. 4, the front jaw 4 or alternatively the heel jaw 5 also if necessary may be designed so that it can be detached or removed from the linking member 24 and/or 28. In particular, a connecting device 53 is provided, by means of which the linking member 24 can be mechanically connected to the front jaw 4. By preference, this connecting device 53 is provided in the form of a ratchet connection 54 with matching projections and recesses disposed in an elastically resilient mounting on the linking member 24 and the front jaw 4. As a result, the linking member 24; 28 can be mounted, packaged and sold separately from the front and heel jaws 4; 5, thereby offering compact packing units. An end-user or retailer will then couple the front and heel jaws 4; 5 in a simple manner with the bar-shaped linking member 24; 28 using the connecting device 53 and the ratchet connection 54. The ratchet connection 54 is preferably designed as a snap-fit connection. Optionally, it would also be possible to connect said jaws to the respective linking members 24, 28 by means of a screw fitting.

The ratchet connection 54 is preferably provided as an elastically resilient, flexible release 55 in the linking member 24; 28, the end regions of which will be brought to bear in a matching recess 56 in the front jaw 4 or in the heel jaw 5.

The connecting device 53 will therefore be a quick-fit system, enabling rapid assembly, preferably without the need for any tools or aids.

The connecting device 53 may also be provided in the form of a threaded spindle arrangement 57—in a manner known per se. As a result of this threaded spindle arrangement 57, the heel jaw 5 in particular could be joined to the linking member 28 co-operating therewith if necessary, if the heel jaw 5 and the linking member 28 are provided as separate components. It will also be possible—in a manner known per se—to displace this threaded spindle arrangement 57 in a longitudinal direction of the linking member 28 if the spindle is rotated. This spindle will then locate in matching slit-shaped recesses in the linking member 28 in a positive fit. If necessary, it would also be possible to use this threaded spindle arrangement 57 to separate the heel jaw 5 from the linking member 28.

The threaded spindle arrangement 57 might also be an elastically resilient thrust bearing. This elastically resilient thrust bearing would cause the heel jaw 5 to apply a specific pre-tensioning force to the ski boot.

One particular advantage which all of the embodiments described above have in common is that because of the positioning and locking device 16, a single fixing member 39 can be used simultaneously both to adjust and lock the distance between front and back jaws 4, 5 and the relative position of the ski binding 3 with respect to the ski 2 as desired.

Figure 5:
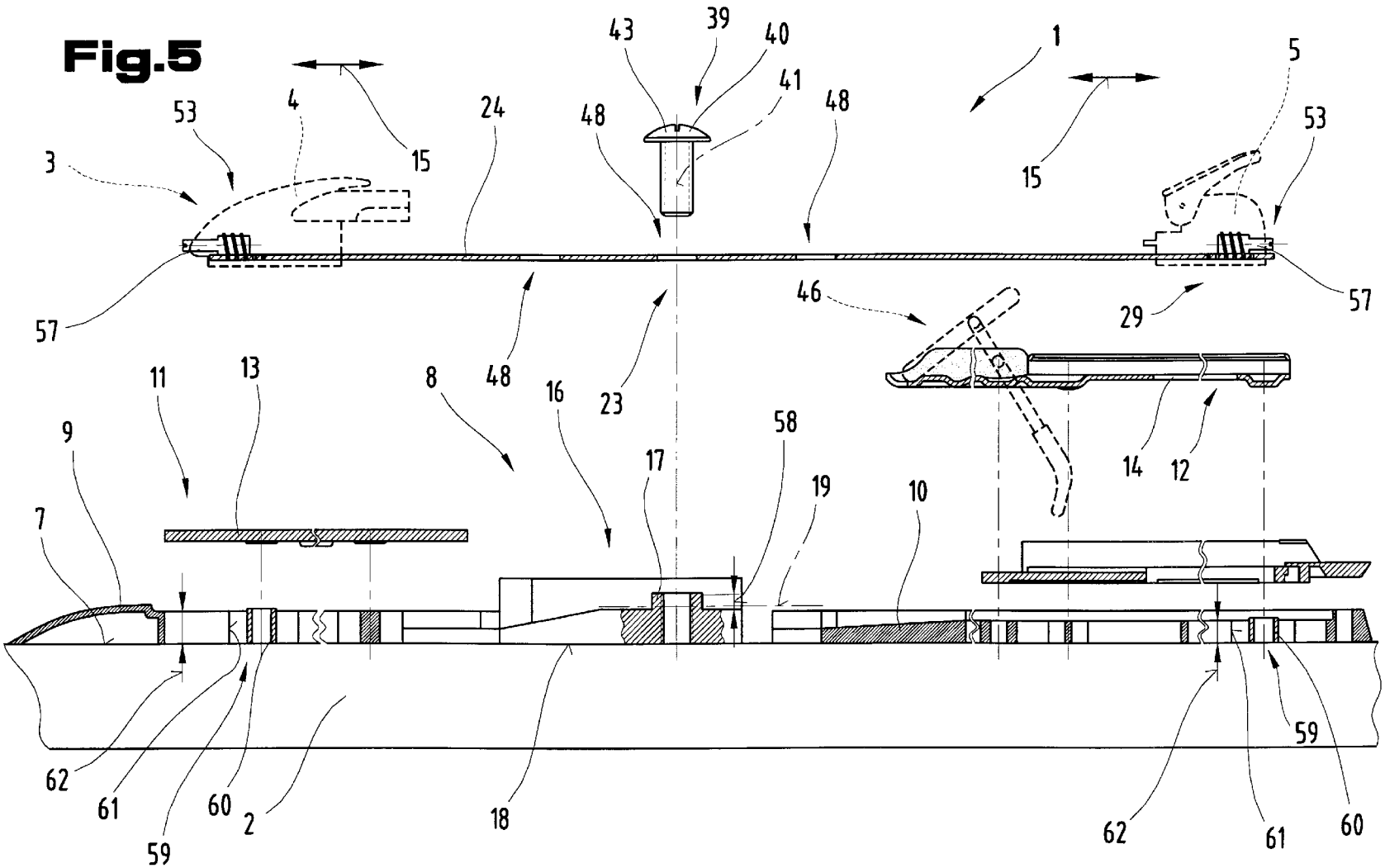
FIG. 5 shows a very simplified, exploded diagram in partial section from a side view, showing another embodiment of the binding mounting system proposed by the invention with a one-part binding element between front and heel jaws.

FIG. 5 illustrates another embodiment of the binding mounting system 1 proposed by the invention, the same reference numbers being used to denote the same components as those described above.

In this case, a one-piece bar-shaped linking member 24 is provided, to the end regions of which the front jaw 4 on the one hand and the heel jaw 5 on the other can be secured by means of the connecting device 53. In the example illustrated here, both the front jaw 4 and the heel jaw 5 are joined to the end regions of the linking member 24 by means of a connecting device 53 in the form of a threaded spindle arrangement 57. Consequently, both the front jaw 4 and the heel jaw 5 can be displaced as required in a longitudinal direction—arrow 15—of the linking member 24 or the base plate 8 and fixed in the desired position without the need for locking mechanisms. Because the front jaw 4 and the heel jaw 5 can be displaced relative to the linking member 24 or relative to the plate-shaped base member 8, the relative position of the ski binding 3 with respect to the base element 8 and a ski 2 can be varied as required. Markings on the housing of the front and/or heel jaws 4, 5 and on the linking member 24 or the base element 8 facilitate adjustment to the respective desired position.

Several orifices 48 are provided in the central region of the linking member 24, spaced at a distance apart from one another in the longitudinal direction of the linking member 24. A distance between the orifices 48 corresponds to the smallest possible adjustment or displacement width of the linking member 24 relative to the base element 8. The shapes and/or dimensions of the orifices 48 are selected so that the raised portion 17 of the positioning and locking device 16 can be at least partially inserted in them. In particular, the desired orifice 48 of the plurality of orifices 48 in the linking member can be displaced by a positive-fit meshing action with the raised portion 17.

The fixing member 39, in particular the fixing screw 40 enables the linking member 24 and the ski binding 3 to be secured in the assumed desired position relative to the base element 8.

By means of the connecting devices 53, in particular the threaded spindle arrangements 57, an adjustment within an adjustment range of approximately 100 mm can be made between the smallest and the largest boot size. Furthermore, the relative position of the ski binding 3 with respect to the base element 8 can be adjusted to a certain degree.

Basically, the relative position of the ski binding 3 with respect to a ski 2 can also be adjusted or varied by means of the plurality of orifices 48 in the centre region of the linking member 24 in co-operation with the positioning and locking device 16 on the base element 8.

Optionally, a height of the raised portion 17 measured perpendicular to the plane 19 is selected so as to match a thickness of the linking member 24 so that the linking member 24 is able to move freely in the height direction to a certain extent. As a result, the linking member 24 will initially not be deformed if the base element 8 or the ski 2 are subjected to bending but will largely remain straight, which means that the distance between front and heel jaws 4, 5 will not be shortened.

By preference, the end regions of the two longitudinal guide mechanisms 11, 12 and the guide components 13, 14 facing away from each other are supported on the top face 7 of a ski 2 by means of spacing members 59, in particular in the form of spacing sleeves 60. The spacing members 59 pass through the plate component 9 and the plate component 10 by means of longitudinal bores 61 disposed in the longitudinal direction—arrow 15—of the binding mounting system 1. A height or length of the spacing sleeves 60 is selected so as to be slightly greater than a depth 62 of the longitudinal bores 61 as measured in the direction of the thickness of the plate components 9, 10. As a result, the plate components 9, 10 are still able to move with respect to the longitudinal guide mechanisms 11, 12 and guide components 13, 14 producing a longitudinal compensation in the event of any bending in the binding mounting system 1 and preventing any torsion in the ski 2 so that the inherent flexibility of the ski 2 will largely remain unaffected. This longitudinal compensation is made possible in particular due to the longitudinal bores 61 in the plate components 9, 10 and due to the fact that the end regions of the longitudinal guide mechanisms 11, 12 facing away from one another are mounted at a slightly higher level than the plate components 9, 10 lying underneath. The example described above may clearly also be used with the embodiments illustrated in FIGS. 1 to 4.

For the sake of good order, it should be pointed out that in order to provide a clearer understanding of the binding mounting system 1, it and its component parts are not illustrated to scale, and/or have been enlarged and/or reduced.

The independent solutions proposed by the invention to the set task can be obtained from the description.

Above all, the individual embodiments and features illustrated in FIGS. 1, 2, 3; 4; 5 may be construed as independent solutions to the invention in their own right. The respective tasks and solutions may be obtained from the detailed descriptions of these drawings.

LIST OF REFERENCE NUMBERS

1. Binding mounting system
2. Ski
3. Ski binding
4. Front jaw
5. Heel jaw
6. Fixing member
7. Top face (ski)
8. Base element (plate-design)
9. Plate component (front)
10. Plate component (rear)
11. Longitudinal guide mechanism (front)
12. Longitudinal guide mechanism (rear)
13. Guide component
14. Guide component
15. Arrow (longitudinal direction)
16. Positioning and locking device
17. Raised portion
18. Bearing surface
19. Plane
20. Teeth
21. Flank
22. Flank angle
23. Recess
24. Linking member
25. Teeth
26. End region (of front jaw)
27. Pivot axis
28. Linking member
29. End region (of heel haw)
30. End region (of positioning device)
31. Recess (underside of 28)
32. Teeth
33. Underside
34. Raised portion (top of 24)
35. Teeth (top of 24)
36. Top face (of linking member 24)
37. Flank
38. Flank angle
39. Fixing member
40. Fixing screw
41. Screw axis
42. Threaded nut
43. Screw head
44. Cover element
45. Slide plate
46. Braking device
47. Mounting seat
48. Orifice
49. Internal thread
50. External diameter
51. Internal diameter
52. External diameter
53. Connecting device
54. Ratchet connection
55. Release
56. Recess
57. Threaded spindle arrangement
58. Height
59. Spacing member
60. Spacing sleeve
61. Longitudinal bore
62. Depth

What is claimed is:

1. A binding mounting system for rapidly mounting a slidable front jaw and a slidable rear jaw of a ski binding onto a ski having a top face, which comprises (a) a plate-shaped base element having a bearing surface and mounted on the top face of the ski, (b) a front longitudinal guide mechanism and a rear longitudinal guide mechanism on the base element, the guide mechanisms preventing vertical and transverse displacements of the front jaw and the rear jaw to be mounted on the base element relative to the bearing surface thereof, (c) a positioning and locking device immobile relative to the base element and arranged thereon between the front and rear longitudinal guide mechanisms at a distance therefrom, the positioning and locking device having a top face remote from the base element and (1) having at least one rigid raised portion with steep flanks on the top face, and (d) a bar-shaped linking member extending towards a respective one of the guide mechanisms and having an end linked to a respective one of the jaws, the linking member having several recesses matching the rained portion to provide a positive fit between the raised portion and one of the recesses.

2. The binding mounting system of claim 1, wherein the guide mechanisms are integrally formed on the base element.

3. The binding mounting system of claim 1, wherein the guide mechanisms are separate and secured to the base element.

4. The binding mounting system of claim 1, wherein the rigid raised portion is comprised of several teeth extending transversely to a longitudinal direction of the base element in a plane extending parallel to the bearing surface of the base element, each tooth having steep flanks, and the recesses in the linking member are formed by teeth providing a positive fit with the teeth of the rigid raised portion.

5. The binding mounting system of claim 1, wherein the positioning and locking device comprises a screw-threaded fixing member having an axis extending perpendicularly to the bearing surface of the base element, turning of the screw-threaded fixing member vertically adjusting the linking member relative to the raised portion and thereby selectively providing a released position and a locked position wherein a respective one of the jaws is locked in a longitudinal direction of the guide mechanisms.

6. The binding mounting system of claim 1, wherein the recesses are disposed in an underside of the linking member facing the base element.

7. The binding mounting system of claim 1, wherein the linking member has at least one raised portion with relatively flat flanks facing the top face of the positioning and locking device.

8. The binding mounting system of claim 1, wherein the linking member is comprised of two parts, a respective one of the linking member parts having an end linked to a respective one of the jaws, a first one of the linking member parts having raised portions on a top face thereof and a second one of the linking member parts having matching recesses on an underside thereof, the recesses matching the raised portions to provide a positive fit between the raised portions and the recesses.

9. The binding mounting system of claim 1, wherein the plate-shaped base element is comprised of two parts, the front jaw being mounted on a front one of the base element parts and the rear jaw being mounted on a rear one of the base element parts.

10. The binding mounting system of claim 1, further comprising a cover element of substantially U-shaped cross section covering the positioning and locking device.

11. The binding mounting system of claim 1, wherein the positioning and locking device comprises a single fixing member enabling the front and rear jaws to be positioned independently of each other relative to the base element while retaining a sliding movement of the jaws in the longitudinal guide mechanisms in the event of deformation of the base element or the ski.

12. The binding mounting system of claim 4, wherein the flanks of the teeth project substantially vertically from a horizontal plane.

13. The binding mounting system of claim 7, wherein the raised portion is comprised of several teeth extending transversely to a longitudinal direction of the base element, each tooth having relatively flat flanks.

14. The binding mounting system of claim 8, wherein the raised portions and recesses are formed by teeth of triangular cross section with relatively flat flanks.

15. The binding mounting system of claim 8, wherein the raised portions and recesses are sinuous.

16. The binding mounting system of claim 8, wherein the ends of the linking member parts facing the positioning and locking device are in flush alignment and are fork-shaped.

17. The binding mounting system of claim 8, wherein the two linking member parts have facing overlapping ends opposite the ends linked to the jaws, and further comprising a fixing member securing the overlapping ends to the positioning and locking device.

18. The binding mounting system of claim 9, wherein the positioning and locking device is joined to the front base element part.

19. The binding mounting system of claim 9, further comprising a braking device for the Ski, the rear base element part having a bearing seat for the braking device at an end of the rear base element part facing the front base element part.

20. The binding mounting system of claim 10, wherein the element also partially covers the linking member.

* * * * *